US006154241A

United States Patent [19]

Matsukawa et al.

[11] Patent Number: 6,154,241

[45] Date of Patent: Nov. 28, 2000

[54] THERMOSENSITIVE COLOR PRINTING METHOD AND THERMOSENSITIVE COLOR PRINTER

[75] Inventors: Hiroyuki Matsukawa; Nobuo Katsuma; Shigeru Tagaya, all of Saitama, Japan

[73] Assignee: Fuji Photo Film Co., Ltd., Kanagawa, Japan

[21] Appl. No.: 09/458,075

[22] Filed: Dec. 10, 1999

[30] Foreign Application Priority Data

Dec. 10, 1998 [JP] Japan ..... 10-351465
Dec. 16, 1998 [JP] Japan ..... 10-358021

[51] Int. Cl.[7] ..... B41J 2/32

[52] U.S. Cl. ..... 347/175; 347/212

[58] Field of Search ..... 347/175, 212; 400/120.01, 120.02, 120.03

[56] References Cited

U.S. PATENT DOCUMENTS 5,486,856 1/1996 Katsuma et al. ..... 347/175
5,892,530 4/1999 Ueda et al. ..... 347/175

FOREIGN PATENT DOCUMENTS 07032625 3/1995 Japan ..... B41J 2/32
09174891 8/1997 Japan ..... B41J 2/32

*Primary Examiner*—Huan Tran

*Attorney, Agent, or Firm*—Sughrue, Mion, Zinn, Macpeak & Seas, PLLC

[57] ABSTRACT

A thermosensitive color recording sheet includes yellow, magenta and cyan thermosensitive coloring layers formed on a support. A thermal head heats there recording sheet for recording on the yellow coloring layer while the recording sheet is transported in a forward direction through the thermal head at a speed predetermined according to a thermal sensitivity of the yellow coloring layer. A yellow fixing lamp disposed behind the thermal head in the forward direction applies near ultraviolet rays to the recording sheet to fix the yellow coloring layer. The yellow fixing lamp is maintained at an irradiance set value while the recording sheet is transported in the forward direction. The irradiance set value is determined based on a maximum irradiance of the yellow fixing lamp that is measured prior to the thermal recording on the yellow coloring layer while driving the yellow fixing lamp by a drive pulse signal at a maximum duty factor. The recording sheet is then transported in a rearward direction under the yellow fixing lamp, to refix the yellow coloring layer. For the refixing, the yellow fixing lamp is maintained at a second irradiance set value determined based on a second maximum irradiance of the yellow fixing lamp that is measured at the end of the forward transport of the recording sheet, whereas the recording sheet is transported the rearward direction at a transport speed determined in accordance with the second irradiance set value.

13 Claims, 12 Drawing Sheets

THERMOSENSITIVE COLOR PRINTING METHOD AND THERMOSENSITIVE COLOR PRINTER

BACKGROUND OF THE INVENTION

1. Field of the Invention

The present invention relates to a thermosensitive color printing method and a thermosensitive color printer for use with a thermosensitive color recording medium. More particularly, the present invention relates to a thermosensitive color printer and an optical fixing method therefor, wherein the thermosensitive color recording medium is moved relative to a thermal head and an optical fixing device twice for one color frame, to do thermal recording and fixing of one color frame during the first relative movement, and a supplementary refixing of that color frame during the second relative movement.

2. Background Arts

The thermosensitive color recording medium consists of cyan (C), magenta (M) and yellow (Y) thermosensitive coloring layers that are formed on atop another on a support and develop the respective colors when heated. The obverse or the topmost thermosensitive coloring layer has the highest thermal sensitivity, whereas the bottommost thermosensitive coloring layer has the lowest thermal sensitivity. Because of the different thermosensitivities of the three coloring layers, three color frames are recorded sequentially from the obverse coloring layer by applying different ranges of heat energies for different colors. The heat energies are applied directly from a thermal head to the thermosensitive recording medium while it is moved relative to the thermal head.

After a color frame is recorded on the obverse coloring layer, e.g. the yellow thermosensitive coloring layer, coloring capacity of that coloring layer is dissolved by ultraviolet rays of a specific wavelength range. Thereby, the yellow thermosensitive coloring layer is optically fixed, and will not develop color even through higher heat energies are applied for recording a second color frame on the second obverse thermosensitive coloring layer, e.g. the magenta thermosensitive coloring layer. In the same way, the magenta color frame recorded on the magenta thermosensitive coloring layer is optically fixed by ultraviolet rays of another wavelength range. For the optical fixing, an ultraviolet lamp combined with a band-pass filter or two kinds of ultraviolet lamps are used.

Because the thermal sensitivity of the bottommost thermosensitive coloring layer, e.g. the cyan thermosensitive coloring layer, is so low that it would not usually develop color during the preservation, the cyan thermosensitive coloring layer is designed to maintain its coloring capacity. So any optical fixing process for the cyan thermosensitive coloring layer is not carried out.

Since the wavelength range of the ultraviolet rays for fixing the yellow thermosensitive coloring layer slightly overlap that of the ultraviolet rays for the magenta thermosensitive coloring layer, if the exposure amount to the yellow fixing ultraviolet rays is too large, it influences the coloring capacity of the magenta thermosensitive coloring layer. Therefore, the exposure amount to the yellow fixing ultraviolet rays is controlled to be constant by adjusting the radiant intensity of the ultraviolet lamp. On the other hand, since the yellow thermosensitive coloring layer is already fixed when to fix the magenta thermosensitive coloring layer, and also the ultraviolet rays do not affect the cyan thermosensitive coloring layer, the ultraviolet lamp is driven up to its maximum intensity to fix the magenta thermosensitive coloring layer without fail.

As well known in the art, the maximum radiant intensity of the ultraviolet lamp varies depending upon its tube temperature. That is, as shown in FIG. 14, when the ultraviolet lamp is driven by a drive pulse signal at duty factor of 100%, the radiant intensity increases with the tube temperature till it reaches a certain value. Thereafter, the intensity is maintained substantially constant, and above a certain higher limit TH of the tube temperature, the intensity begins to decrease with the tube temperature.

The radiant intensity of the ultraviolet lamp also depends on its running time. In the first stage of usage of the ultraviolet lamp, the radiant intensity increases with time from the start of driving the ultraviolet lamp, and after the intensity reaches a certain degree, it is maintained substantially unchanged with time, as shown by a chain-dotted line in FIG. 15. However, as the total running time increases, mercury is separated and deposited on inside of the tube of the ultraviolet lamp. Radiant intensity of the ultraviolet lamp that has the mercury deposited on the tube decreases with time after it reaches a certain degree, and thereafter increases with time again, as shown by a solid line in FIG. 15. The lowest value of the radiant intensity depends on the mercury deposit condition. It is to be noted that the curves shown in FIG. 15 is also obtained when the ultraviolet lamp is driven to the full by the drive pulse signal at 100% duty factor.

In order to prevent the yellow or the magenta thermosensitive coloring layer from being over- or under-exposed, or being fixed unevenly because of the variations in intensity of the ultraviolet lamp, U.S. Pat. No. 5,486,856 discloses an optical fixing method, wherein the thermosensitive recording medium is transported twice for one color under a specific ultraviolet lamp. Prior to the first transport, a maximum irradiance value of the ultraviolet lamp is measured as it is driven at pulse duty factor of 100%, and a value less than the maximum irradiance value is determined to be an irradiance set value. Then the thermosensitive recording medium is transported first at a first speed relative to the ultraviolet lamp while maintaining its irradiance at the set value. Since a thermal head disposed before the ultraviolet lamp records a color frame on a thermosensitive coloring layer during the first transport, the first speed is predetermined according to the thermosensitivity of that coloring layer to fix. Thereafter, for the supplementary refixing, the thermosensitive recording medium is transported for the second time relative to the ultraviolet lamp while maintaining its irradiance at the set value. The speed for the second relative movement is determined according to the irradiance set value, such that the total amount of exposure to the ultraviolet rays adds up to a predetermined proper value. Since the irradiance and the transporting speed are maintained constant during each transport, the entire area of the thermosensitive color recording medium is evenly fixed.

U.S. Pat. No. 5,892,530 discloses an optical fixing method, wherein a lowest irradiance value of a magenta fixing ultraviolet lamp is detected during a first transport of the thermosensitive recording medium through the magenta fixing ultraviolet lamp. Then, whether to refix the magenta thermosensitive coloring layer or not is determined depending upon the measured lowest irradiance value. If the exposure amount to the ultraviolet rays in the first or main fixing process is estimated to be insufficient, the thermosensitive color recording medium is transported for the second time under the magenta fixing ultraviolet lamp at a speed determined according to the lowest irradiance value. In this way, a supplemental amount of ultraviolet rays are projected onto the magenta thermosensitive coloring layer.

As described above, the radiant intensity of the ultraviolet lamp varies depending upon the tube temperature. Since the tube temperature at the start of the refixing is usually higher than before the main fixing, the maximum irradiance value can also be higher at the start of refixing than the value measured prior to the main fixing. Nevertheless, in the former prior art, the transport speed for the refixing is determined by the irradiance set value that is determined based on the maximum irradiance value measured prior to the main fixing. Therefore, the transport speed for the refixing can be too slow considering the capability of the ultraviolet lamp.

Also in the latter prior art, since the transport speed for the refixing is determined according to the lowest irradiance value so as to obtain a sufficient amount of supplemental exposure even if the irradiance of the ultraviolet lamp is maintained at the lowest value. Therefore, the transport speed for the refixing can be too slow considering the capability of the ultraviolet lamp. In other words, it may be possible to use a higher transport speed in combination with a higher irradiance value for the refixing. The higher transport speed results a shorter refixing times and thus a shorter total printing time.

SUMMARY OF THE INVENTION

In view of the foregoing, an object of the present invention is to provide a thermosensitive color printing method and a thermosensitive color printer wherein the capability of an optical fixing lamp is fully used to achieve shorter fixing times and thus a shorter total printing time.

Another object of the present invention is to provide a thermosensitive color printing method, a thermosensitive color printer which can uniformly and properly fix the coloring layer even if irradiance of the optical fixing lamp varies during the optical fixation.

To achieve the above and other objects in a thermosensitive color printing method, wherein a thermal head effects thermal recording on one of the coloring layers during a first relative movement of the recording medium relative to the thermal head, and an optical fixing device effects optical fixing of the one coloring layer after the thermal recording during the first relative movement as well as during a second relative movement of the recording medium relative to the thermal head, the present invention provides the steps of: measuring, with a sensor, a first maximum irradiance of the optical fixing device while driving it by a drive pulse signal at a maximum duty factor prior to the first relative movement of the recording medium; determining a first irradiance set value in accordance with the first maximum irradiance; causing the first relative movement of the recording medium at a first speed predetermined according to a thermal sensitivity of the one coloring layer; adjusting duty factor of the drive pulse signal to maintain the optical fixing device at the first irradiance set value during the first relative movement of the recording medium; detecting a second maximum irradiance of the optical fixing device prior to the second relative movement of the recording medium; determining a second irradiance set value in accordance with the second maximum irradiance; causing the second relative movement at a second speed that is determined in accordance with the second irradiance set value; and adjusting duty factor of the drive pulse signal to maintain the optical fixing device at the second irradiance set value during the second relative movement of the recording medium.

According to a preferred embodiment, the second maximum irradiance is estimated from the duty factor of the drive pulse signal at the end of the first relative movement and an irradiance value of the optical fixing device measured with the sensor at the end of the first relative movement.

According to another preferred embodiment, the second maximum irradiance is measured with the sensor while driving the optical fixing device at the maximum duty factor. In that case, it is necessary to insert a shutter between the optical fixing device and the recording medium while the second maximum irradiance is measured, where the first relative movement and the second relative movement are effected in opposite directions from each other.

According to the present invention, a thermosensitive color printer for printing a full-color image on a thermosensitive color recording medium including a support, and first, second and third thermosensitive coloring layers formed on the support in this order from an obverse of the recording medium is provided with a thermal head for heating the recording medium to record first to third color frames of the full-color image respectively on the first to third coloring layers sequentially from the first coloring layer; a moving device for moving the recording medium relative to the thermal head, wherein the thermal head effects thermal recording on one of the first to third coloring layers while the recording medium is moved once relative to the thermal head; a first fixing lamp for applying ultraviolet rays to the recording medium in a first wavelength range to fix the first coloring layer optically after the thermal recording on the first coloring layer; a second fixing lamp for applying ultraviolet rays to the recording medium in a second wavelength range to fix the second coloring layer optically after the thermal recording on the second coloring layer; an irradiance measuring device for measuring irradiance of the second fixing lamp; a device for checking if it is necessary to refix the second coloring layer in accordance with a minimum irradiance of the second fixing lamp measured during fixation of the second coloring layer; a speed setting device for determining a transport speed of the recording medium relative to the second fixing lamp for refixing of the second coloring layer in accordance with an initial irradiance value of the second fixing lamp measured immediately before starting refixing; a speed correction device for correcting the transport speed for the refixing in accordance with irradiance of the second fixing lamp measured during the refixing, thereby to accelerate the transport speed when the measured irradiance increases from the initial irradiance value, or decelerate the transport speed when said measured irradiance decreases from the initial irradiance value.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
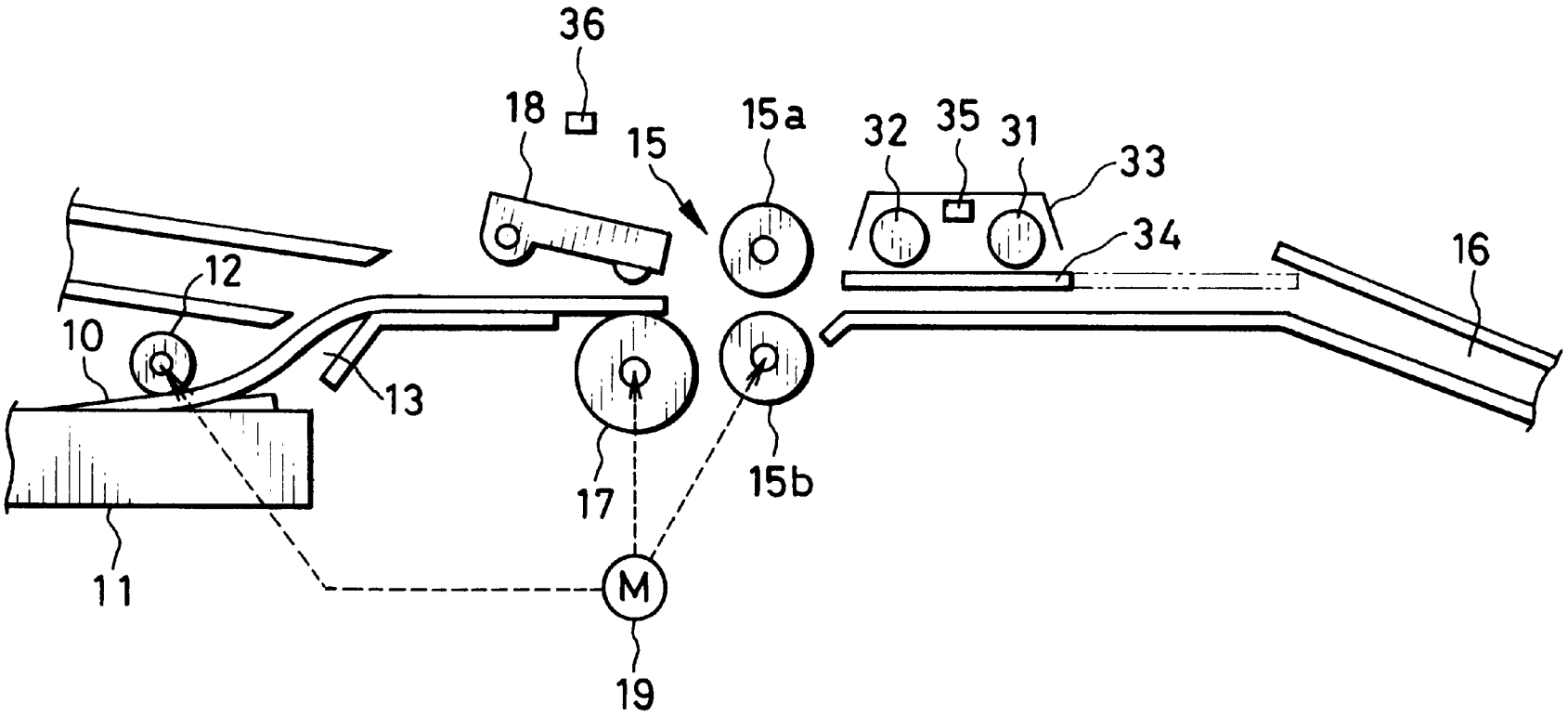
FIG. 1 is a schematic diagram illustrating a thermosensitive color printer according to a first embodiment of the present invention.

In FIG. 1, a plurality of sheets of thermosensitive color recording medium 10, hereinafter referred to as recording sheets 10, are piled in a paper supply tray 11. A paper supply roller 12 is disposed above the paper supply tray 11, and feeds out the recording sheets 10 one by one from the paper supply tray 11 into a paper feed-out path 13. The recording sheet 10 fed out through the paper feed-out path 13 is nipped between a pair of feed rollers 15 consisting of a nip roller 15*a* and a capstan roller 15*b*. Then, the feed rollers 15 transport the recording sheet 10 alternately in a forward direction toward a paper discharge path 16, and in a rearward direction reverse to the forward direction.

A platen roller 17 and a thermal head 18 are disposed between the paper supply tray 11 and the feed roller pair 15. The thermal head 18 has a large number of heating elements arranged in a line across the transporting directions of the recording sheet 10. The thermal head 18 is movable between a pressing direction to press the recording sheet 10 onto the platen roller 17, and a rest position set away from the platen roller 17. The paper supply roller 12, the capstan roller 15*b* and the platen roller 17 are rotated by a motor 19.

Figure 2:
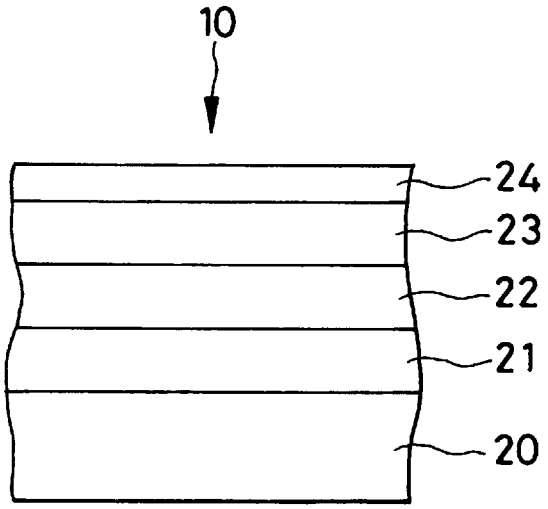
FIG. 2 is an explanatory diagram illustrating a layered structure of a thermosensitive color recording medium.

FIG. 2 shows an example of layered structure of the recording sheet 10, wherein cyan, magenta and yellow thermosensitive coloring layers 21, 22 and 23, and a protection layer 24 are formed on atop another on a support 20. Three color frames are recorded sequentially from the top yellow thermosensitive coloring layer 23 to the bottom cyan thermosensitive coloring layer 21 by applying different ranges of heat energies for different colors. The sequence of these three color thermosensitive coloring layers 21 to 23 is changeable. If the magenta thermosensitive coloring layer is the top coloring layer, a magenta frame is recorded first. Although it is not shown, there are intermediate layers between the coloring layers 21 to 23.

The yellow thermosensitive coloring layer 23 loses its coloring capacity when exposed to near-ultraviolet rays of a wavelength range around 420 nm. The magenta thermosensitive coloring layer 22 loses its coloring capacity when exposed to ultraviolet rays of a wavelength range around 365 nm.

Referring back to FIG. 1, ultraviolet lamps 31 and 32 for fixing the yellow and magenta thermosensitive recording layers 23 and 22 are disposed between the feed roller pair 15 and the paper discharge path 16. The yellow fixing lamp 31 radiates near ultraviolet rays peaking at around 420 nm, whereas the magenta fixing lamp 32 radiates ultraviolet rays peaking at around 365 nm. A reflector 33 reflects the rays from the fixing lamps 31 and 32 toward the recording sheet 10 as it is transported through the feed roller pair 15. A light-shielding shutter 34 is provided to be movable between a closed position placed in front of the fixing lamps 31 and 32 to shield the recording sheet 10 from the lamps 31 and 32, as shown by solid line in FIG. 1, and an open position displaced from the front of the fixing lamps 31 and 32 as shown by phantom lines.

An irradiance sensor 35 is located near the fixing lamps 31 and 32, for measuring irradiance of each of the fixing lamps 31 and 32. A temperature sensor 36 is located in an appropriate position inside the thermosensitive color printer, for measuring environmental temperature.

In the thermosensitive color printer, thermal recording and main optical fixing of a yellow frame as well as those of a magenta frame are performed while the recording sheet 10 is transported in the forward direction. So the yellow fixing lamp 31 or the magenta fixing lamp 32 is turned on during the yellow frame recording or the magenta frame recording, respectively. Also while the recording sheet 10 is transported in the rearward direction after the yellow frame recording, the yellow fixing lamp 31 is driven for refixing. The magenta fixing lamp 32 also continues to work for refixing while the recording sheet 10 is transported in the rearward direction after the magenta frame recording. After the recording sheet 10 is transported in the forward direction for the cyan frame recording, the recording sheet 10 is transported further in the forward direction, and is discharged through the paper discharge path 16.

Figure 3:
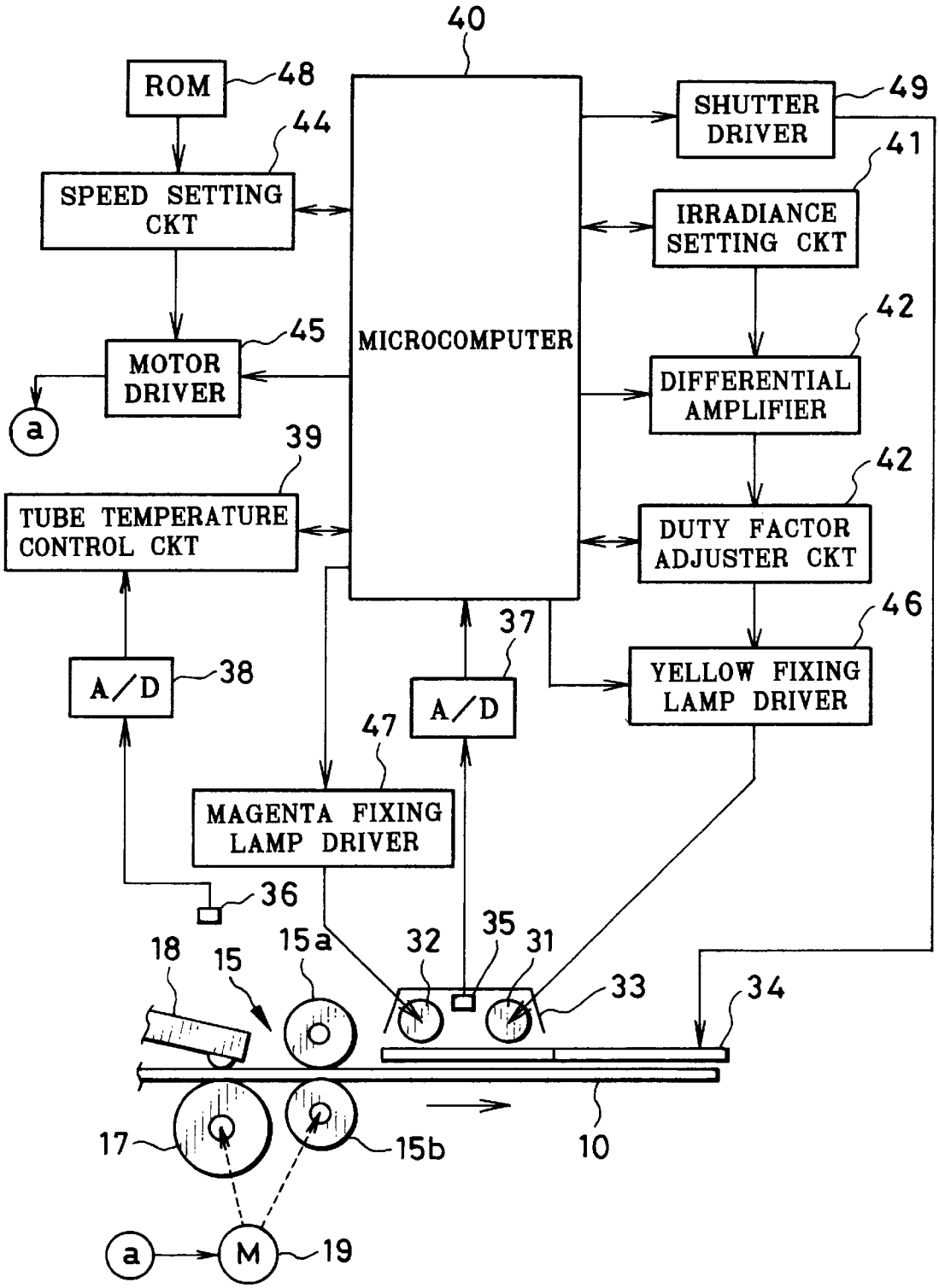
FIG. 3 is a block diagram of the thermosensitive color printer of the first embodiment.
Figure 4:
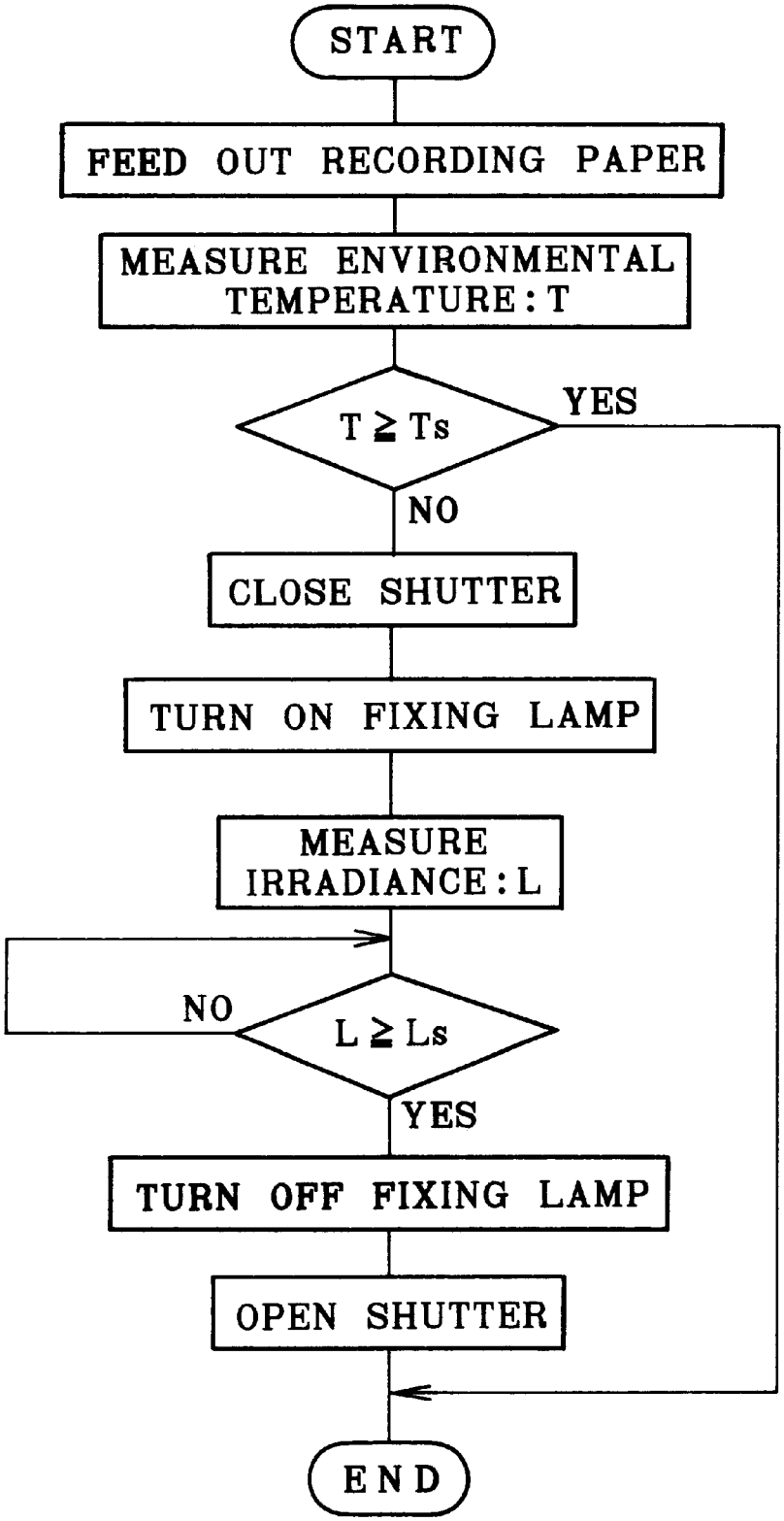
FIG. 4 is a flow chart illustrating a lamp preheating sequence of the thermosensitive color printer.

As shown in FIG. 3, an analog signal from the irradiance sensor 35 is converted through an A/D converter 37 into digital irradiance data representative of a measured irradiance, and the irradiance data is sent to a microcomputer 40. An analog temperature measurement signal from the environmental temperature sensor 36 is converted through an A/D converter 38 into digital temperature data, and the temperature data is sent to a tube temperature control circuit 39. The tube temperature control circuit 39 determines based on the temperature data whether the tube temperature of the fixing lamps 31 and 32 before being driven is high enough for radiating rays at a sufficient intensity from the beginning of fixing process. If the tube temperature is determined to be too low, the tube temperature control circuit 39 requires the microcomputer 40 to start a lamp preheating sequence as shown in FIG. 4.

The microcomputer 40 is also connected to an irradiance setting circuit 41, a differential amplifier 42, a duty factor adjuster circuit 43, a speed setting circuit 44, a motor driver 45 for the motor 19, a yellow fixing lamp driver 46, a magenta fixing lamp driver 47, and a shutter driver 49 for the shutter 34.

The irradiance setting circuit 41 determines a set irradiance value of the yellow fixing lamp 31 based on the irradiance data as set forth in detail later. The differential amplifier 42 is for outputting a difference signal representative of a difference between the irradiance set value and a measured irradiance of the yellow fixing lamp 31. With reference to the difference signal from the differential amplifier 42, the duty factor adjuster circuit 43 adjusts the duty factor of drive pulses applied from the yellow fixing lamp driver 46 to the yellow fixing lamp 31. On the other hand, the magenta fixing lamp driver 47 applies drive pulses at duty factor of 100% to the magenta fixing lamp 32 to drive it up to its maximum intensity.

The speed setting circuit 44 determines transport speeds VY1, VM1 and VC1 of the recording sheet 10 in the forward direction, i.e. ,the transport speeds for the thermal recording of the respective color frames. The speed setting circuit 44 also determines transport speeds VY2 and VM2 in the rearward direction, i.e., the transport speed for the yellow frame refixing and that for the magenta frame refixing. The transport speeds VY1, VM1 and VC1 for the thermal recording are predetermined according to thermal sensitivities of the yellow, magenta and cyan coloring layers 23, 22 and 21. Also the transport speed VM2 in the rearward direction for the magenta frame refixing is predetermined according to the thermal sensitivity of the magenta thermosensitive coloring layer 22. These predetermined values VY1, VM1, VC1 and VM2 are written in a ROM 48. The transport speed VY2 for the yellow frame refixing is determined according to irradiance of the yellow fixing lamp 31 as set forth in detail later. The ROM 48 also stores an operation formula for calculating the transport speed VY2.

In accordance with the transport speed determined by the speed setting circuit 44, the motor driver 45 controls voltage or current of electric power supplied to the motor 19, to control the direction and speed of rotation of the capstan roller 15*b* and the platen roller 17. The shutter driver 49 opens or closes the shutter 34 under the control of the microcomputer 40.

The thermosensitive color printer having the above-described configurations operates as follows:

In response to a print start command, the microcomputer 40 starts the lamp preheating sequence shown in FIG. 4. First, the paper supply roller 12 rotates to feed out the recording sheet 10 from the paper supply tray 11 through the paper feed-out path 13 to the feed roller pair 15. When the leading end of the recording sheet 10 is nipped between the capstan roller 15*b* and the nip roller 15*a*, the paper supply roller 12 stops. During this paper feed-out operation, the thermal head 18 is in the rest position away from the platen roller 17.

Simultaneously with the paper feed-out operation, the tube temperature control circuit 39 compares an environmental temperature T measured through the environmental temperature sensor 36 with a reference environmental temperature Ts. The reference environmental temperature Ts is a degree where the tube temperature of the fixing lamps 31 and 32 reaches a lower limit $T_L$ necessary for radiating rays of a sufficient intensity Is for the optical fixing. That is, the reference environmental temperature Ts corresponds to the lower limit $T_L$ of the tube temperature. In this embodiment, the reference environmental temperature Ts is 12° C.

When the measured environmental temperature T is not less than the reference environmental temperature Ts, it is estimated that the tube temperature is enough for radiating rays of sufficient intensity. So the lamp preheating sequence is terminated, and the thermosensitive color printer starts a printing operation.

When the measured environmental temperature T is less than the reference environmental temperature Ts, it is estimated that the tube temperature is lower than the minimum degree $T_L$. Then, the fixing lamps 31 and 32 are preheated by drive pulses of 100% duty factor. Before starting preheating, the shutter 34 is closed to prevent the recording sheet 10 from being fogged. During the preheating, irradiance L of the yellow fixing lamp 31 is detected through the irradiance sensor 35, so as to turn off the fixing lamps 31 and 32 when the irradiance L reaches a predetermined level Ls. Thereafter, the shutter 34 is opened, and the printing operation starts.

Since the recording sheet 10 is already nipped between the feed rollers 15*a* and 15*b*, the thermal head 18 can start recording the yellow frame immediately after the preheating. Therefore, the total printing time is shortened as compared with the case where the recording sheet 10 is fed out from the paper supply tray 11 after the preheating. Also because the time lag from the preheating to the actual fixing process is shortened, the preheated fixing lamp is efficiently utilized for fixing.

Figure 6:
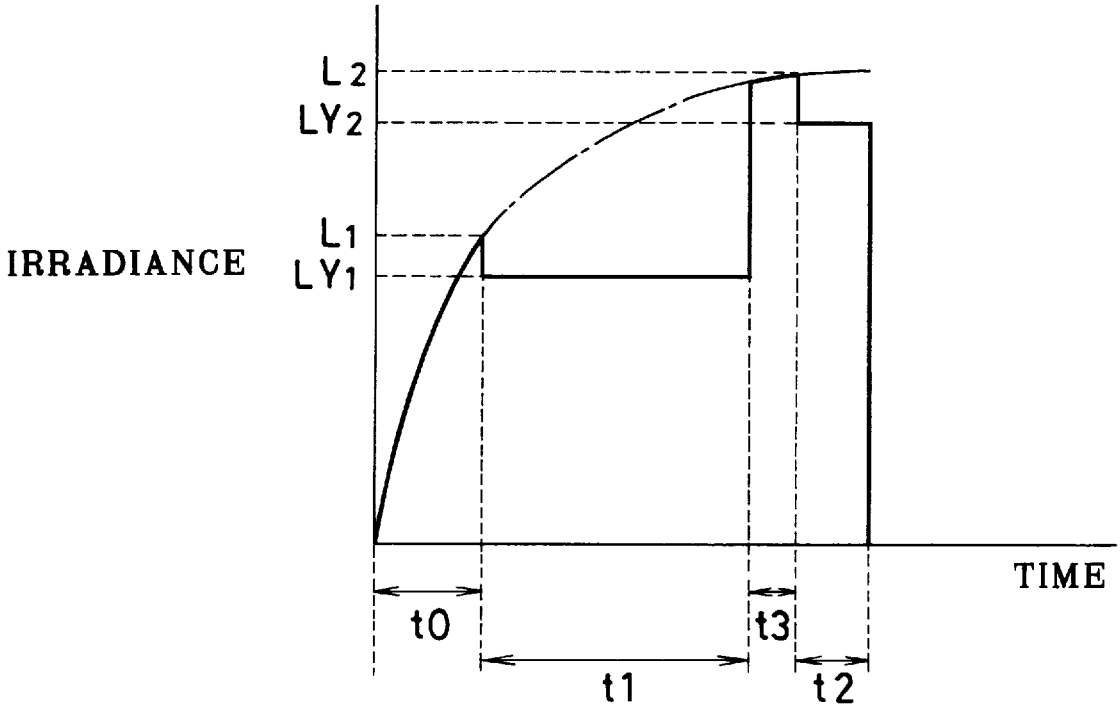
FIG. 6 is a graph illustrating an irradiance curve of a yellow fixing lamp driven according to the first embodiment.
Figure 5:
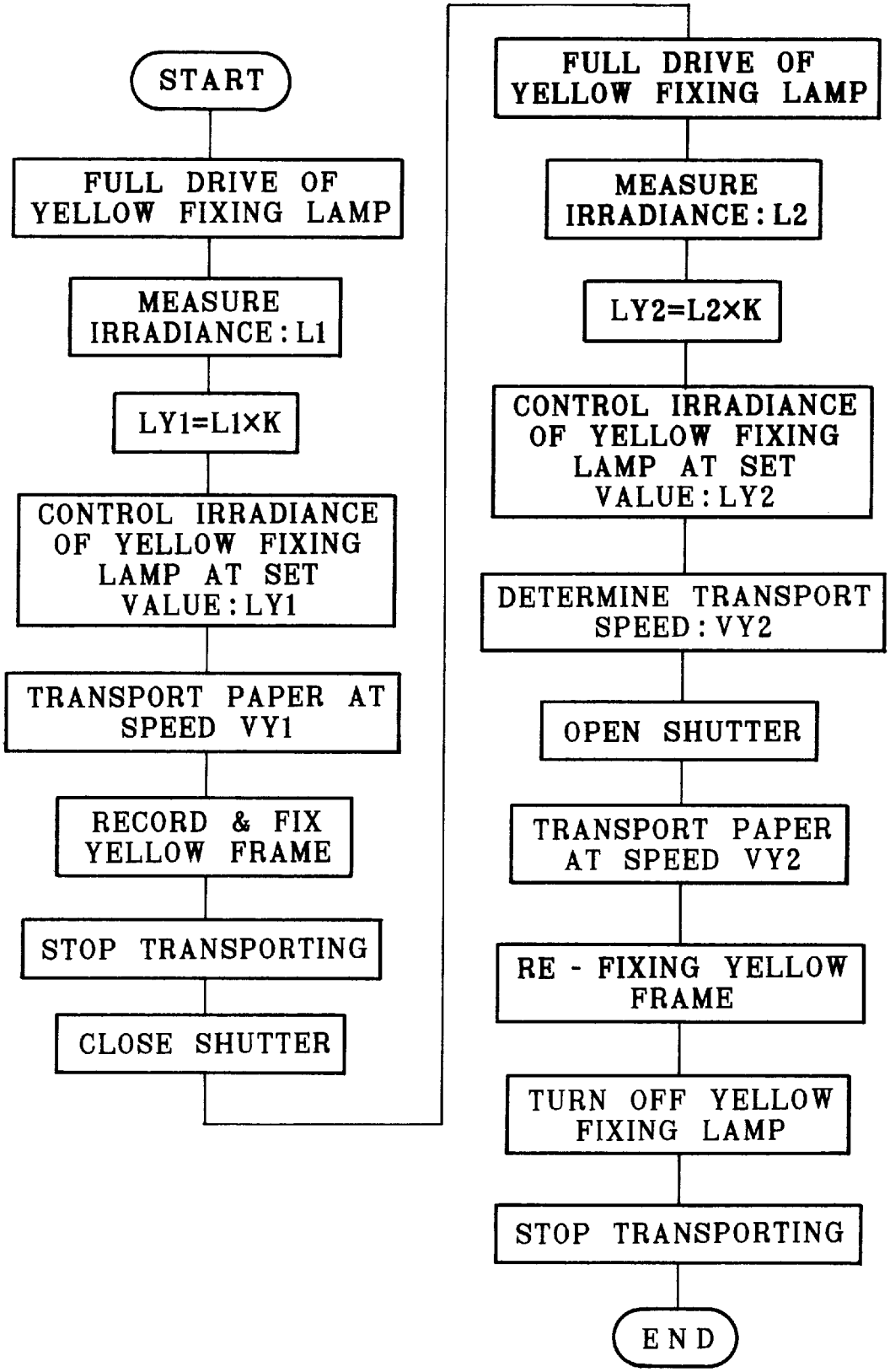
FIG. 5 is a flow chart illustrating a yellow frame recording sequence according to the first embodiment.

In the printing operation, first the yellow frame is recorded on the yellow thermosensitive coloring layer 23 according to the sequence shown in FIG. 5. First, the yellow fixing lamp 31 is driven by drive pulses of 100% duty factor for a predetermined time t0, e.g. 0.5 seconds, as shown in FIG. 6. The microcomputer 40 monitors an irradiance value L1 of the yellow fixing lamp 31 measured by the irradiance sensor 35 when the time t0 has passed from the start of driving, and sends data of the measured irradiance L1 to the irradiance setting circuit 41, wherein the irradiance value L1 is regarded as a maximum irradiance value of the yellow fixing lamp 31 achievable during the yellow frame main fixing. The irradiance setting circuit 41 multiplies the irradiance value L1 by a coefficient K to determine an irradiance set value LY1. For example, the coefficient K is 0.9.

After the irradiance set value LY1 is determined, the irradiance data from the irradiance sensor 35 is continuously transferred to the differential amplifier 42. The differential amplifier 42 detects the difference between the irradiance L and the irradiance set value LY1, and outputs a difference signal to the duty factor adjuster circuit 43. Then, the duty factor adjuster circuit 43 adjusts the duty factor of the drive pulses for the yellow fixing lamp 31, so as to maintain irradiance of the yellow fixing lamp 31 at the set value LY1. Concretely, the duty factor is raised when the measured irradiance L is less than the set value LY1, whereas the duty factor is lowered when the measured irradiance L is more than the set value LY1.

While the irradiance setting circuit 41 determines the irradiance set value, the speed setting circuit 44 reads out the transport speed VY1 for the yellow frame recording from the ROM 48. The transport speed VY1 is predetermined according to the thermal sensitivity of the yellow thermosensitive coloring layer 23. When the speed VY1 is set in the motor driver 45, the thermal head 18 moves to the pressing position, and the motor 19 rotates the platen roller 17 and the capstan roller 15*b* so as to transport the recording sheet 10 in the forward direction at the speed VY1 (the first relative movement of the recording sheet 10 to the thermal head 18 and the fixing lamps 31 and 32).

Although the shutter 34 is opened while the irradiance L1 is measured, it is alternatively possible to open the shutter 34 after the irradiance set value LY1 is determined.

While the recording sheet 10 moves past the thermal head 18 in the first relative movement, the yellow frame is recorded line by line on the yellow thermosensitive coloring layer 23. The yellow thermosensitive coloring layer 23 having the yellow frame recorded thereon is optically fixed by the rays from the yellow fixing lamp 31 while the recording sheet 10 moves past the yellow fixing lamp 31 at the speed VY1. Since the irradiance of the yellow fixing lamp 31 is maintained at the set value LY1 in the first relative movement, the entire area of the recording sheet 10 is equally exposed to the near ultraviolet rays from the yellow fixing lamp 31.

After completing recording the yellow frame, the thermal head 18 moves back to the rest position. When the trailing end of the recording sheet 10 reaches the feed roller pair 15, the motor driver 45 stops driving the motor 19.

Then, the shutter 34 is closed, and the yellow fixing lamp 31 is driven up to its maximum intensity by applying the drive pulses at the pulse duty factor of 100% for a time t3. An irradiance value L2 is measured when the yellow fixing lamp 31 has been driven up to its maximum intensity for the time t3, wherein the irradiance value L2 is regarded as a maximum irradiance value of the yellow fixing lamp 31 achievable during the yellow frame refixing. Then, the irradiance setting circuit 41 determines a second irradiance set value LY2 by multiplying the irradiance value L2 by the coefficient K.

After the second irradiance set value LY2 is determined, irradiance of the yellow fixing lamp 31 is controlled to be the set value LY2 by adjusting the duty factor of the drive pulses applied from the yellow fixing lamp driver 46 through the differential amplifier 42 and the duty factor adjuster circuit 43 in the same way as for the first irradiance set value LY1.

While the irradiance setting circuit 41 determines the second irradiance set value LY2, the speed setting circuit 44 determines the transport speed VY2 for the yellow frame refixing, i.e., the transport speed VY2 of the recording sheet 10 in the rearward direction (a second relative movement of the recording sheet 10 to the fixing lamps 31 and 32 and the thermal head 18). The transport speed VY2 is determined such that the total exposure amount $S_T$ of the recording sheet 10 to the near ultraviolet rays from the yellow fixing lamp 31 adds up to a predetermined proper value. The total exposure amount $S_T$ is given by the following equation:

$$S_T = LY1 \times t1 + LY2 \times t2$$

wherein t1 is a time duration of the yellow frame main fixing or an exposure time of the recording sheet 10 to the rays from the yellow fixing lamp 31 in the first relative movement, and t2 is a time duration of the refixing of the yellow frame or an exposure time of the recording sheet 10 to the rays from the yellow fixing lamp 31 in the second relative movement.

Because the exposure times t1 and t2 depend on the transport speeds VY1 and VY2 respectively, the transport speed VY2 for the yellow frame refixing is calculated from the transport speed VY1 and the first and second irradiance set values LY1 and LY2.

Since the second irradiance set value LY2 is determined based on the maximum irradiance value L2 of the yellow fixing lamp 31 measured immediately before the yellow frame refixing, and the transport speed VY2 for the yellow frame refixing is determined taking the second irradiance set value LY2 into consideration, the transport speed VY2 comes to be an optimum value with respect to the maximum irradiance of the yellow fixing lamp 31 achievable during the yellow frame refixing. Because the tube temperature of the fixing lamp 31 is higher at the start of refixing than at the start of main fixing, the second maximum irradiance value L2 is usually higher than the first maximum irradiance value L1. So the transport speed VY2 is usually higher than a value that is determined only by the first irradiance set value LY1.

After the transport speed VY2 is determined, the shutter 34 is opened, and the motor 19 starts rotating the capstan roller 15*b* to transport the recording sheet 10 in the rearward direction at the speed VY2. When the leading end of the recording sheet 10 in the forward direction goes past the yellow fixing lamp 31 in the rearward direction, the yellow fixing lamp 31 is turned off. When the leading end of the recording sheet 10 reaches the feed roller pair 15, the rearward transport of the recording sheet 10 is stopped.

Then, the microcomputer 40 starts a magenta frame recording sequence. The speed setting circuit 44 reads the predetermined transport speed VM1 for the magenta frame recording from the ROM 48, and sets it to the motor driver 45. Then, the thermal head 18 presses the recording sheet 10 onto the platen roller 18, and the magenta fixing lamp 32 is turned on. Because the cyan thermosensitive coloring layer 21 is not affected by the rays from the fixing lamps 31 and 32, over-exposure to the magenta frame fixing rays is no problem, so the magenta fixing lamp driver 47 always drives the magenta fixing lamp 32 to the full with drive pulses of 100% duty factor.

The motor 19 rotates the capstan roller 15*b* to transport the recording sheet 10 in the forward direction at the speed VM1, while the thermal head 18 records the magenta frame line by line on the magenta thermosensitive coloring layer 22. The magenta thermosensitive coloring layer 22 having the magenta frame recorded thereon is subjected to main fixing by the ultraviolet rays from the magenta fixing lamp 32 as the recording sheet 10 is transported under the magenta fixing lamp 32 in the forward direction.

After completing recording the magenta frame, the thermal head 18 moves back to the rest position. When the trailing end of the recording sheet 10 reaches the feed roller pair 15, the motor driver 45 deactivates the motor 19 to stop transporting the recording sheet 10 in the forward direction.

Then, the motor driver 45 starts driving the motor 19 to transport the recording sheet 10 in the rearward direction at the predetermined speed YM2 that is set by the speed setting circuit 44 with reference to the ROM 48. During this rearward transport, the magenta fixing lamp 32 continues being driven to the full, thereby to project a sufficient amount of ultraviolet rays onto the recording sheet 10 for refixing the magenta frame.

When the leading end of the recording sheet 10 in the forward direction reaches the transport roller pair 15, the rearward transport of the recording sheet 10 is stopped, and then a cyan frame recording sequence starts.

The thermal head 18 presses the recording sheet 10 onto the platen roller 17 and records the cyan frame line by line, while the recording sheet 10 is transported in the forward direction at the speed VC1 predetermined according the thermal sensitivity of the cyan thermosensitive coloring layer 21. Although the cyan frame does not need optical fixing, the magenta fixing lamp 32 continues radiating the ultraviolet rays during the cyan frame recording, to bleach blank areas of the recording sheet 10 that otherwise bear a yellowish hue because of the heat. After the cyan frame recording, the recording sheet 10 is discharged through the paper discharge path 16 onto a not-shown tray.

Figure 7:
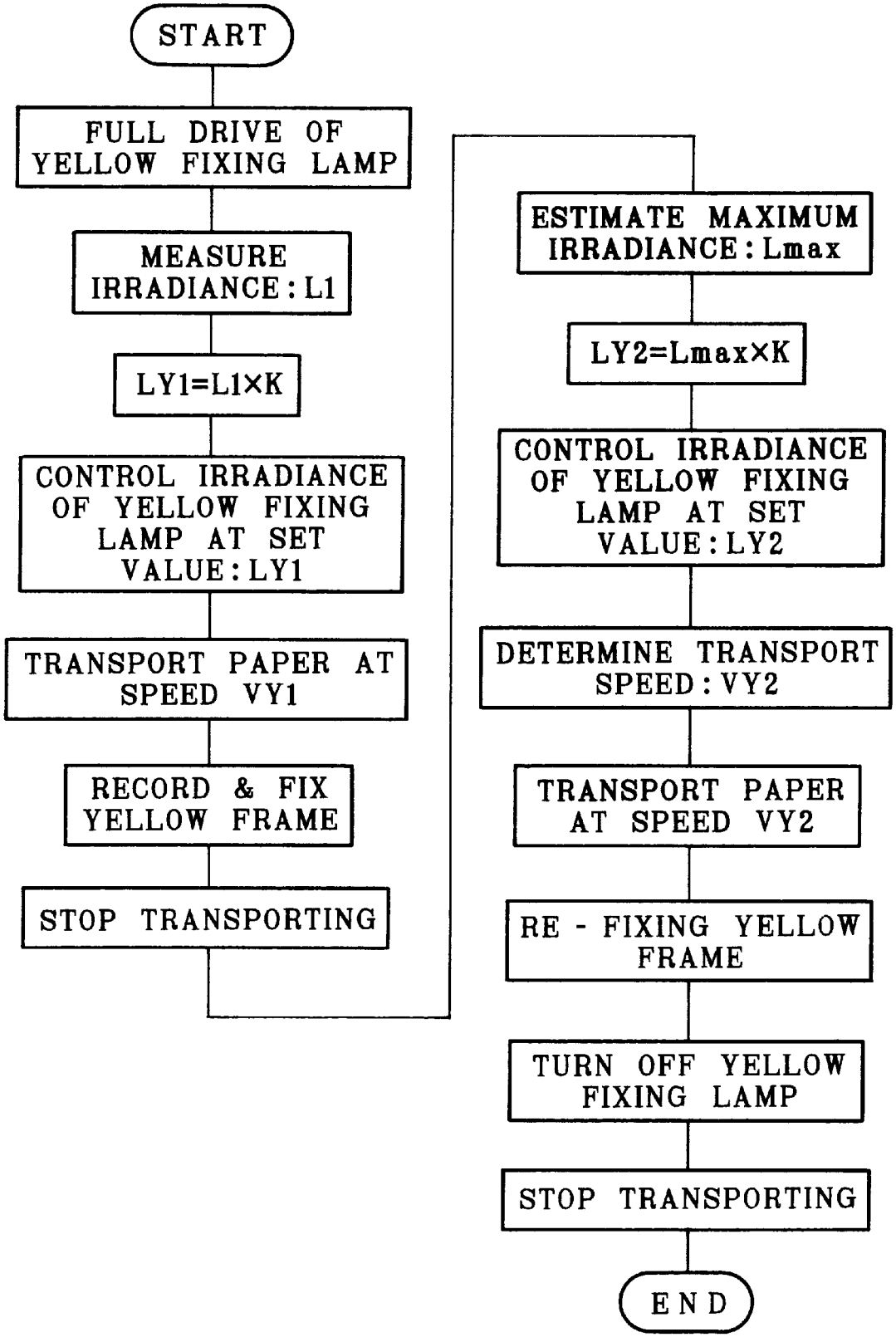
FIG. 7 is a flow chart illustrating a yellow frame recording sequence according to a second embodiment of the invention.
Figure 8:
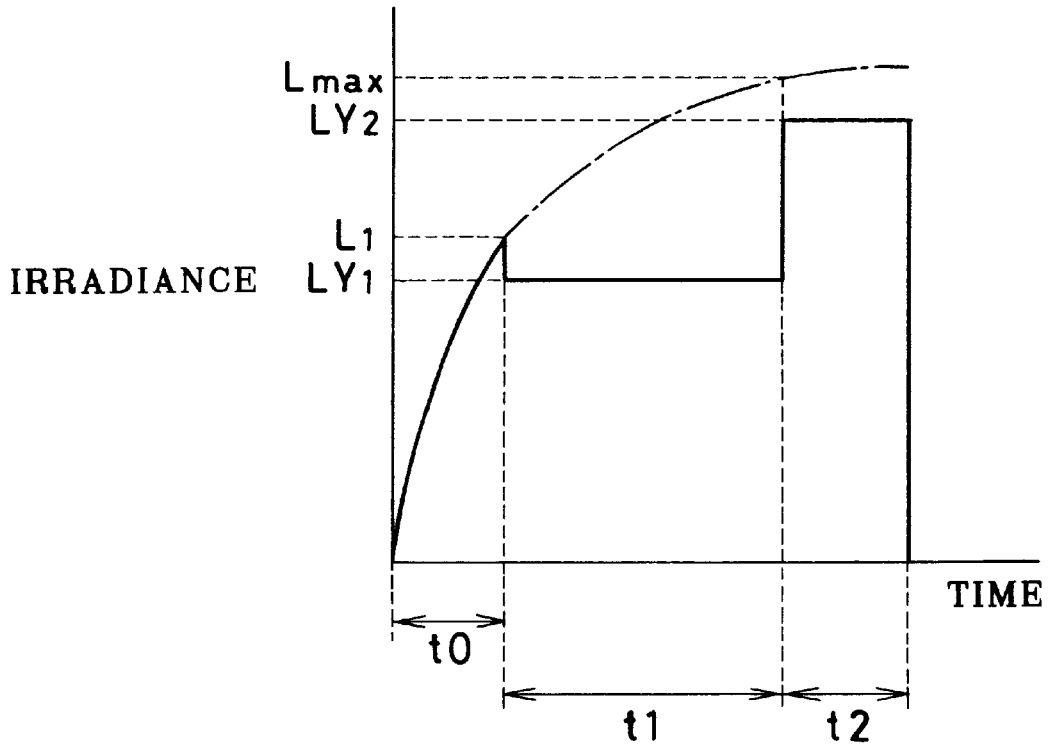
FIG. 8 is a graph illustrating an irradiance curve of a yellow fixing lamp driven according to the second embodiment.
Figure 9:
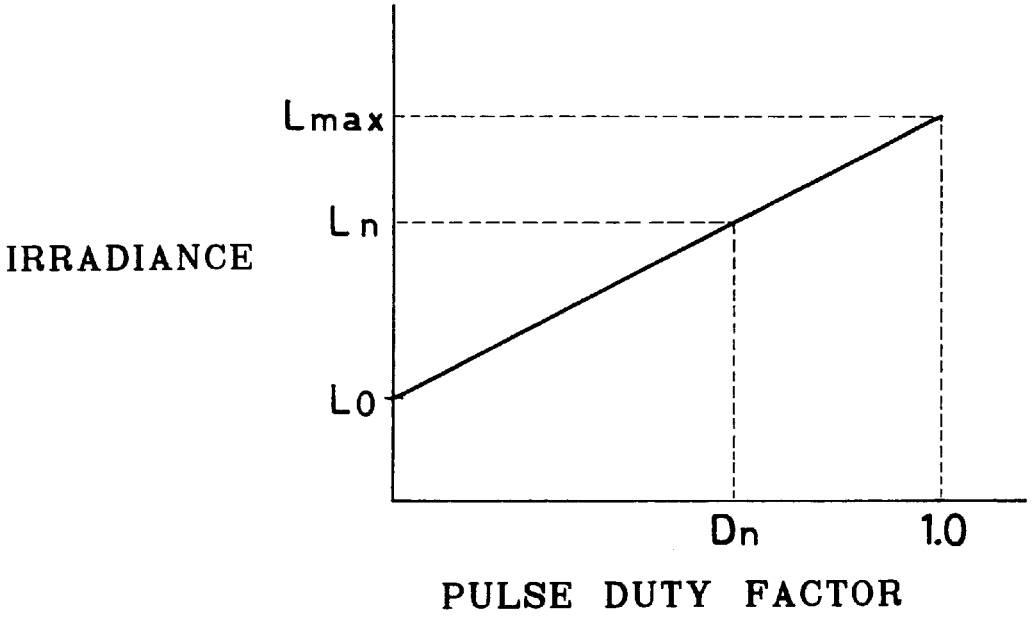
FIG. 9 is a graph illustrating a relationship between irradiance of the yellow fixing lamp and duty factor of drive pulses for the yellow fixing lamp.

Now, an optical fixing method according to the second embodiment of the present invention will be described with reference to FIGS. 7 to 9.

In the second embodiment, the yellow frame main fixing is carried out in the same way as the first embodiment, but the transport speed VY2 for the yellow frame refixing is determined based on a maximum irradiance value Lmax that is estimated from irradiance L of the yellow fixing lamp 31 measured at the end of yellow frame main fixing. Because irradiance L of the fixing lamp increases proportionally to the duty factor D of the drive pulse, the relationship between these values L and D is given as follows:

$$L=\alpha\times D+Lo$$

wherein $\alpha$ is a proportional constant and Lo is an offset value, which are specific to the ultraviolet lamp.

Therefore, the maximum irradiation value Lmax achieved at 100% pulse duty factor is given as follows:

$$Lmax=\alpha\times 1.0+Lo$$

Provided that an irradiance value Ln is obtained at an appropriate pulse duty factor Dn, the proportional constant $\alpha$ is given as follows:

$$\alpha=(Ln-Lo)/Dn$$

Accordingly, the maximum irradiance value Lmax may be calculated by the following formula:

$$Lmax = \{(Ln - Lo)/Dn\} + Lo$$
$$= \{Ln + Lo \times (Dn - 1)\}/Dn$$

By substituting the irradiance of the yellow fixing lamp 31 and a pulse duty factor De at the end of the yellow frame main fixing for the values Ln and Dn in the above equation of the maximum irradiance value Lmax, it is possible to estimate the maximum irradiance value Lmax of the yellow fixing lamp 31. Since the irradiance of the yellow fixing lamp 31 is maintained at the first irradiance set value LY1 during the yellow frame main fixing, the microcomputer 40 monitors the pulse duty factor De at the end of the yellow frame main fixing from the duty factor adjuster circuit 43, and transfers it to the irradiance setting circuit 41. The irradiance setting circuit 41 calculates the maximum irradiance value Lmax based on these values LY1 and De, and multiplies the maximum irradiance value Lmax by the coefficient K to determine the second irradiance set value LY2. The speed setting circuit 44 then determines the transport speed VY2 for the yellow frame refixing in the same way as the first embodiment.

According to the second embodiment, it is unnecessary to drive the yellow fixing lamp 31 to the full to measure the maximum irradiance value prior to the yellow frame refixing. Therefore, the shutter 34 does not need to shield the recording sheet 10 from the fixing lamps 31 and 32 during the printing operation. Using the optical fixing method of the second embodiment, the shutter 34 may be omitted from the thermosensitive color printer.

Figure 10:
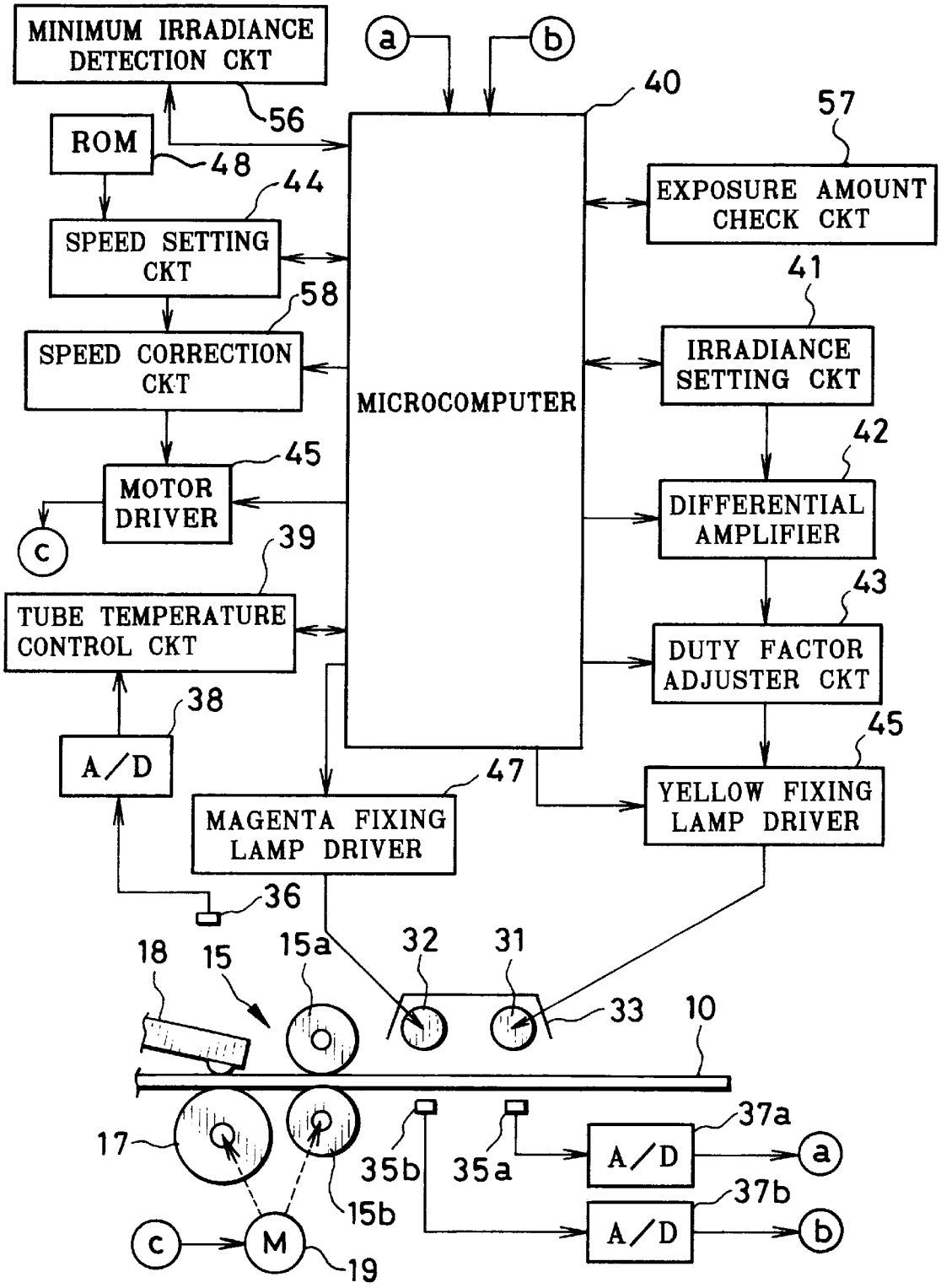
FIG. 10 is a block diagram of a thermosensitive color printer according to a third embodiment of the present invention.

FIG. 10 shows a thermosensitive color printer according to the third embodiment of the present invention, wherein like or corresponding parts are designated by the same reference numerals as used in the first embodiment, so the following description relates only to those features essential for the third embodiment.

A pair of irradiance sensors 35*a* and 35*b* are disposed respectively near yellow and magenta fixing lamps 31 and 32 to measure irradiance of the fixing lamps 31 and 32. Measured irradiance values are supplied to a microcomputer 40 after being converted into digital irradiance data through A/D converters 37*a* and 37*b*.

In addition to a tube temperature control circuit 39, an irradiance setting circuit 41, a differential amplifier 42, a duty factor adjuster circuit 43, a speed setting circuit 44, a motor driver 45, a yellow fixing lamp driver 46, a magenta fixing lamp driver 47, and a ROM 48, the microcomputer 40 is connected to a minimum irradiance detection circuit 56, an exposure amount check circuit 57, and a speed correction circuit 58.

Also in this embodiment, each recording sheet 10 is transported twice, i.e. back and forth, relative to a thermal head 18 and a yellow fixing lamp 31 for recording and fixing a yellow frame, and then twice relative to the thermal head 18 and a magenta fixing lamp 32 for recording and fixing a magenta frame. Thereafter, the recording sheet 10 is transported once in the forward direction relative to the thermal head 18 for recording a cyan frame.

The ROM 48 stores transport speeds VY1, VM1 and VC1 of the recording sheet 10 in the forward direction for the yellow, magenta and cyan frame recording. The transport speeds VY1, VM1 and VC1 are predetermined according to the respective thermal sensitivities of the yellow, magenta and cyan thermosensitive coloring layers 23, 22 and 21. The ROM 48 also stores operation formulas for calculating transport speeds VY2 and VM2 of the recording sheet 10 in the rearward direction after the yellow frame recording and after the magenta frame recording.

Figure 11:
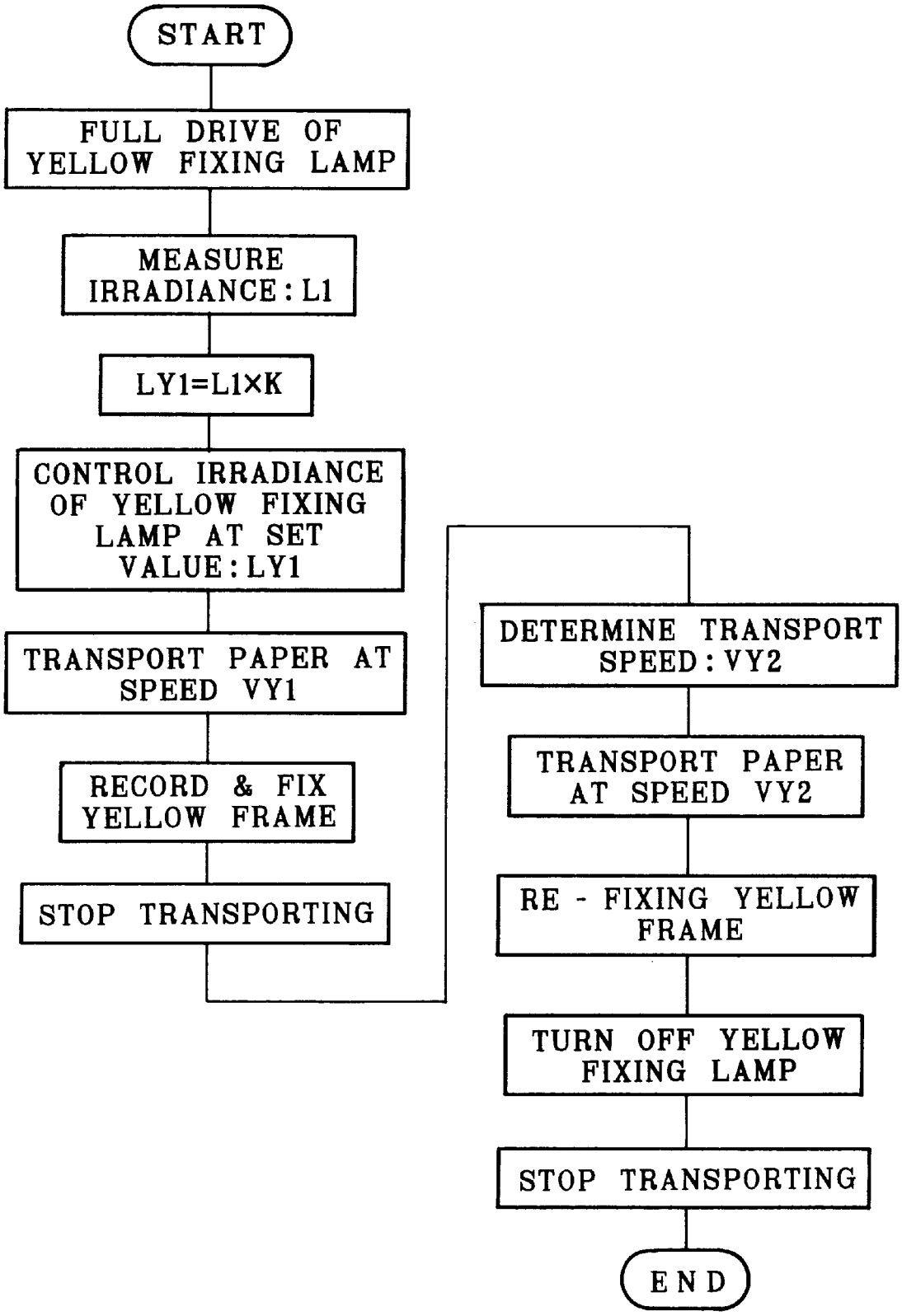
FIG. 11 is a flow chart illustrating a yellow frame recording sequence according to the third embodiment.

In the third embodiment, the yellow frame is recorded according to a sequence shown in FIG. 11. In the same way as the first embodiment, an irradiance value L1 of the yellow fixing lamp 31 is measured by the irradiance sensor 35*a* prior to starting recording the yellow frame while driving the yellow fixing lamp 31 to the full with drive pulses of 100% duty factor. Then, an irradiance set value LY1 is determined by the measured irradiance value L1. Thereafter while the irradiance of the yellow fixing lamp 31 is maintained at the set value LY1 through the differential amplifier 42 and the duty factor adjuster circuit 43, the recording sheet 10 is transported at the predetermined speed VY1 for the yellow frame recording and main fixing.

At the end of the yellow frame main fixing, the transport speed VY2 in the rearward direction is determined based on the irradiance set value LY1 and the transport speed VY1 such that the total exposure amount ST of the recording sheet 10 to near ultraviolet rays from the yellow fixing lamp 31 during the main fixing and the refixing adds up to be a predetermined value. In this embodiment, the irradiance of the yellow lamp 31 is maintained at the set value LY1 during the refixing, so the total exposure amount ST is given as follows:

$$ST=LY1\times(tY1+tY2)$$

wherein tY1 and tY2 represent an exposure time during the yellow frame main fixing and an exposure time during the yellow frame refixing which are determined by the transport speeds VY1 and VY2 respectively.

If the irradiance set value LY1 is high, and thus the exposure amount during the main fixing is large, the transport speed VY2 is set to be a higher value to shorten the exposure time tY2 for the yellow frame refixing. On the contrary, if the irradiance set value LY1 is low, the transport speed VY2 is set to be a lower value.

Figure 12:
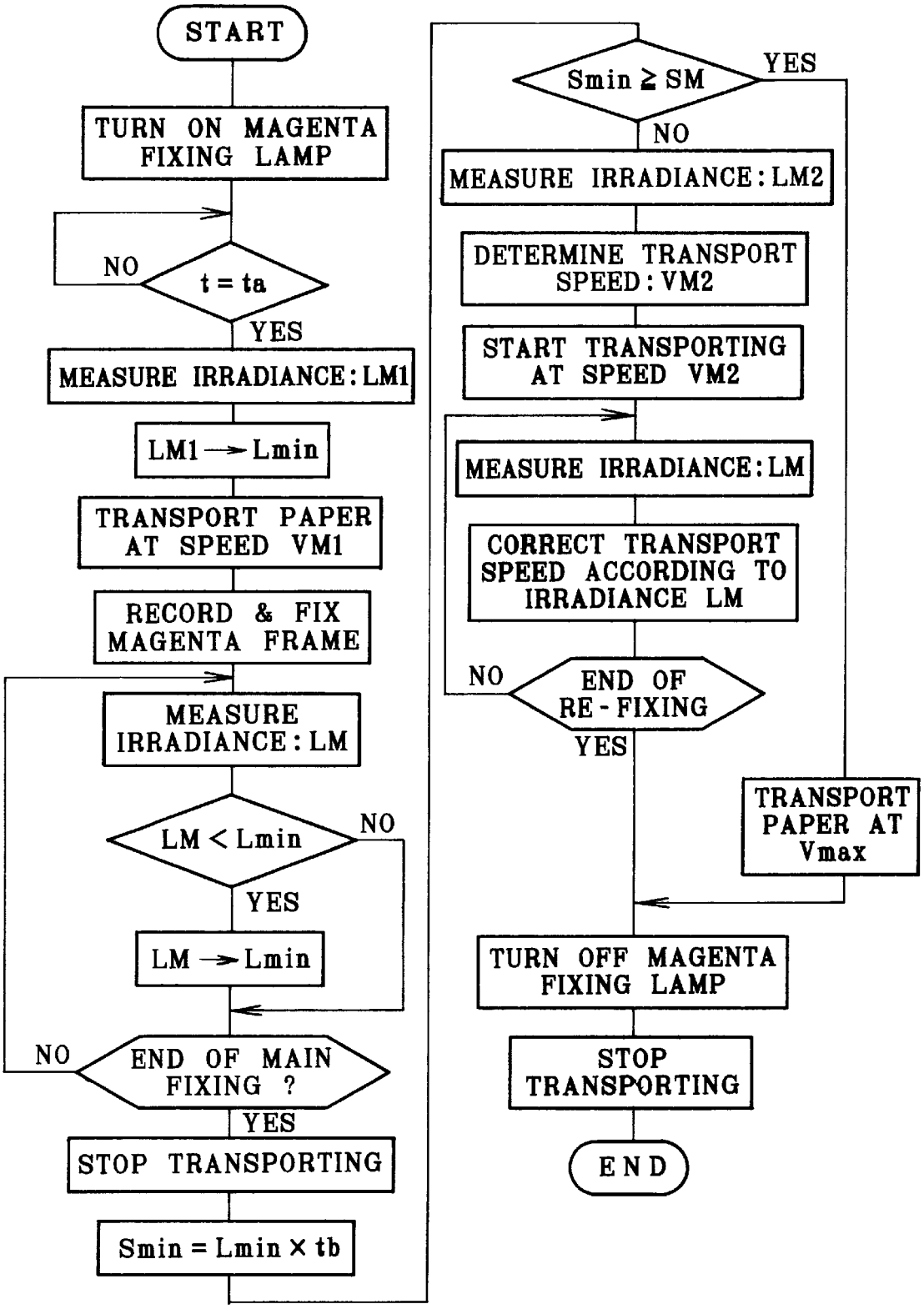
FIG. 12 is a flow chart illustrating a magenta frame recording sequence according to the third embodiment.

After the yellow frame is recorded and fixed this way, a magenta frame is recorded and fixed according to the sequence shown in FIG. 12.

Figure 13:
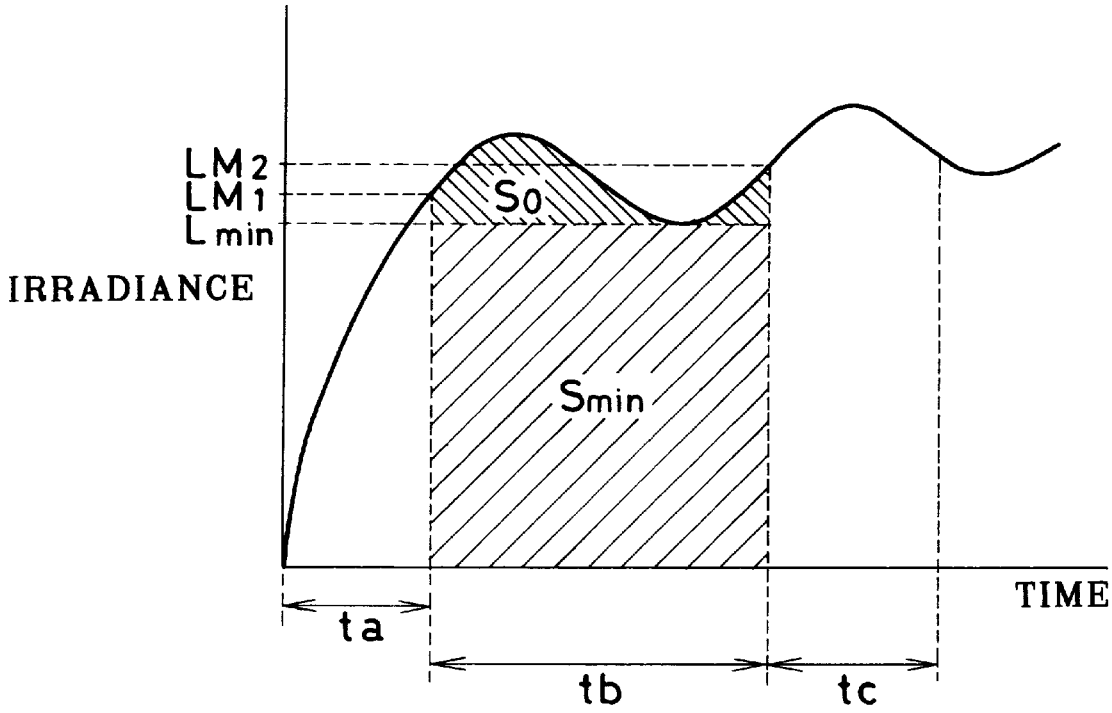
FIG. 13 is a graph illustrating an irradiance curve of a magenta fixing lamp driven according to the third embodiment.
Figure 14:
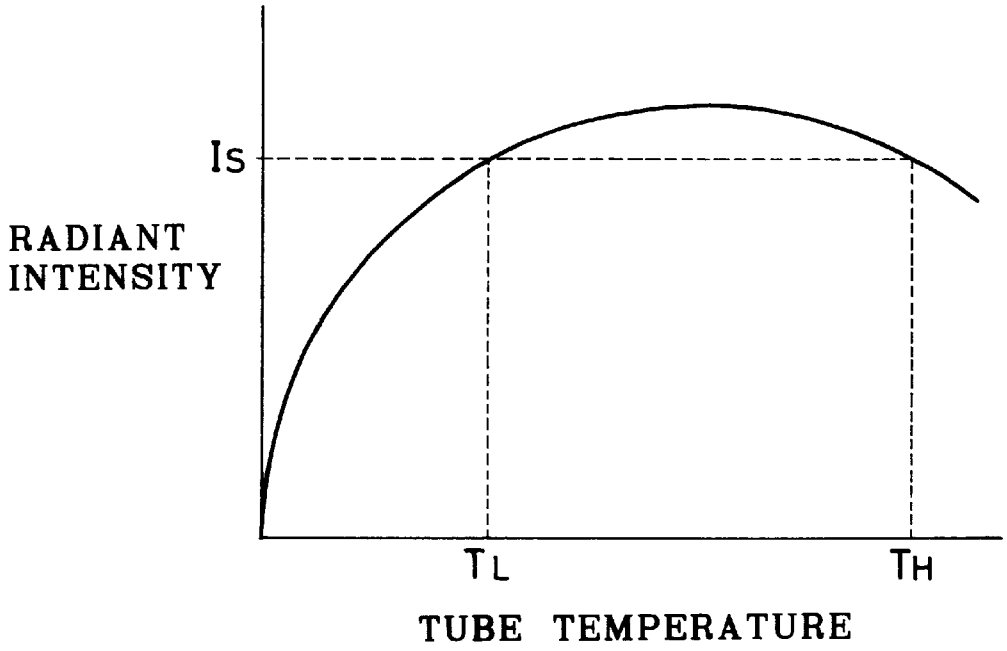
FIG. 14 is a graph illustrating a relationship between radiant intensity and tube temperature of an ultraviolet lamp.
Figure 15:
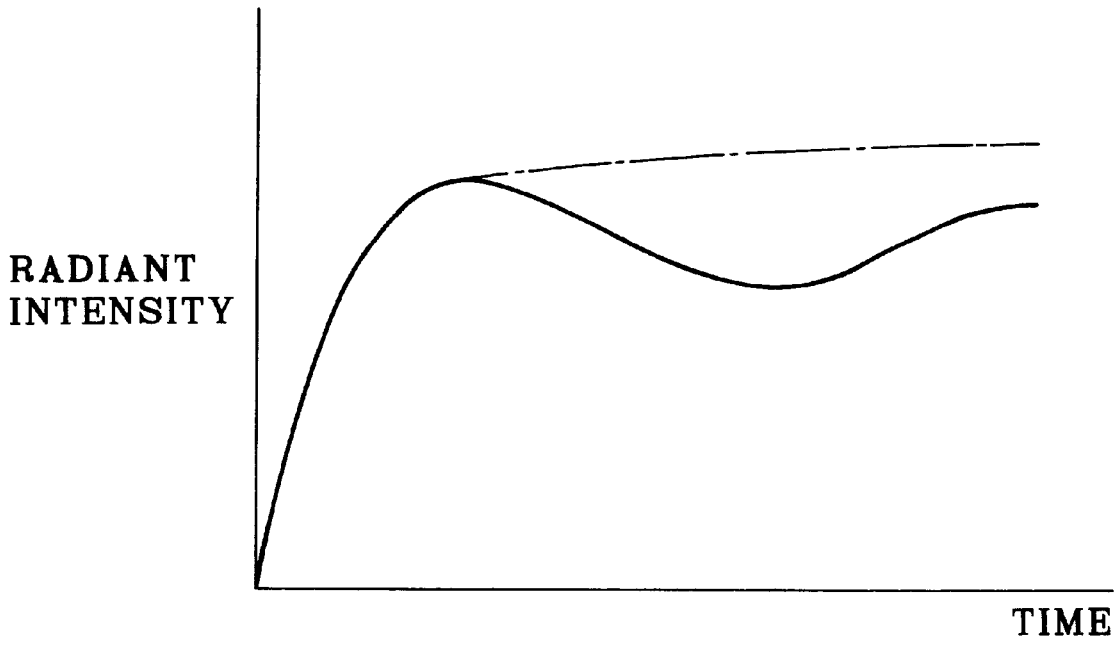
FIG. 15 is a graph illustrating a relationship between radiant intensity of an ultraviolet lamp and time.

As described above with reference to FIG. 15, since radiant intensity of the fixing lamp 31 or 32 begins to fluctuate after a certain total running time because of the deposited mercury, the irradiance sensor 35*b* keeps measuring irradiance LM of the magenta fixing lamp 32 throughout the magenta frame main fixing and refixing. FIG. 13 shows an example of irradiance curve measured by the irradiance sensor 35*b*. Because the cyan thermosensitive coloring layer 21 is not affected by the rays from the fixing lamps 31 and 32, the magenta fixing lamp 32 is always driven to the full with drive pulses of 100% duty factor.

After a time ta, e.g. 0.5 seconds, has elapsed from the start of driving the magenta fixing lamp 32, the microcomputer 40 monitors the irradiance LM measured by the irradiance sensor 35*b* as an initial value LM1, and transfers it to the minimum irradiance detection circuit 56. Simultaneously, the recording sheet 10 stars being transported at the predetermined speed VM1 in the forward direction. Thereafter, data of the measured irradiance LM is continuously sent to the minimum irradiance detection circuit 56, to detect the lowest irradiance value measured during the main fixing as a minimum irradiance value Lmin. If the initial value LM1 is the lowest among the measured irradiance values LM, the initial value LM1 is regarded as the minimum irradiance value Lmin.

After the main fixing is completed, the exposure amount check circuit 57 calculates a minimum exposure amount Smin based on the minimum irradiance value Lmin. The minimum exposure amount Smin represents a least amount of the ultraviolet rays assumed to be projected at least from the magenta fixing lamp 32 onto the recording sheet 10 during the main fixing, that is given as follows:

$$Smin=Lmin\times tb$$

wherein tb is an exposure time for the magenta frame main fixing, which is determined by the transport speed VM1.

As shown in FIG. 13, the actual exposure amount of the recording sheet 10 to the magenta fixing rays is more than the minimum exposure amount Smin by an amount S0.

Thereafter, the exposure amount check circuit 57 compares the minimum exposure amount Smin with a predetermined lower limit $S_M$ of exposure amount necessary for fixing the entire magenta thermosensitive coloring layer 22 of the recording sheet 10. If the minimum exposure amount Smin is more than the lower limit $S_M$, it is unnecessary to refix the magenta frame. Therefore, the microcomputer 40 drives a motor 19 through the motor driver 45 to drive a motor 19 to transport the recording sheet 10 at a maximum speed Vmax in the rearward direction. When the recording sheet 10 is moved back to a print start position where the leading end of the recording sheet 10 in the forward direction is nipped between a pair of feed rollers 15, the rearward transport of the recording sheet 10 stops, and the magenta fixing lamp 32 is turned off.

If the minimum exposure amount Smin is less than the lower limit $S_M$, the actual exposure amount Smin+S0 can be less than the lower limit $S_M$, so the magenta frame refixing is effected in the following manner. First, the speed setting circuit 44 determines the transport speed VM2 for the magenta frame refixing in accordance with an irradiance value LM2 of the magenta fixing lamp 32 measured at the end of the magenta frame main fixing and the minimum exposure amount Smin, such that the total amount of exposure for the magenta frame adds up to be more than the lower limit $S_M$. That is, the transport speed VM2 is calculated according to the following formula:

$$VM2=(LM2\times\beta)/(S_M-Smin)$$

wherein β is a transport distance corresponding to the length of the recording sheet 10 in the transporting direction.

Data of the transport speed VM2 determined by the speed setting circuit 44 is sent to the motor driver 45 through the speed correction circuit 45. As soon as the recording sheet 10 starts being transported in the rearward direction at the transport speed VM2, the speed correction circuit 58 corrects the transport speed VM2 based on the measured irradiance LM from the irradiance sensor 35*b* according to the following formula:

$$V=VM2\times(LM/LM2).$$

Then data of a corrected speed V is applied to the motor driver 45, so the motor driver 45 drives the motor 19 to transport the recording sheet 10 at the corrected speed V. Accordingly, if the measured irradiance LM of the magenta fixing lamp 32 goes above the irradiance value LM2 of the magenta fixing lamp 32 measured at the end of the magenta frame main fixing, the transport speed in the rearward direction is increased from the initially determined transport speed VM2. If the measured irradiance LM goes below the initially measured value LM2, the transport speed is decreased from the initial set value VM2.

Since the transport speed in the rearward direction for the magenta frame refixing is initially determined based on the irradiance value LM2 of the magenta fixing lamp 32 measured at the end of the magenta frame main fixing, and is accelerated or decelerated in accordance with variations in irradiance of the magenta fixing lamp 32, it is possible to determine an optimum transport speed for the magenta frame refixing with respect to the capability of the magenta fixing lamp 32, and for exposing the entire area of the recording sheet 10 uniformly. Because the exposure time for the magenta frame refixing is shortened when the irradiance of the magenta fixing lamp 32 increases, the total printing time is shortened, in comparison with the case where the transport speed for the magenta frame refixing is determined based on the minimum irradiance value Lmin. When the irradiance of the magenta fixing lamp 32 decreases, the exposure time for refixing is elongated, so the recording sheet 10 is sufficiently exposed to the ultraviolet rays from the magenta fixing lamp 32.

After the magenta frame is recorded and fixed in this way, a cyan frame is recorded in the same way as in the first embodiment while the recording sheet 10 is transported in the forward direction for the third time. Although the magenta fixing lamp 32 is turned off at the end of the magenta frame recording sequence shown in FIG. 12, it is possible to keep driving the magenta fixing lamp 32 during the cyan frame recording for the sake of bleaching.

Although preheating of the fixing lamps 31 and 32 in the third embodiment has not been described, it is preferable to preheat the fixing lamps 31 and 32 prior to the printing process. Since the thermosensitive color printer of the third embodiment does not have a shutter, the preheating should be executed before the recording sheet 10 reaches the print start position, preferably while the recording sheet 10 is fed out from the paper supply tray 11.

It is also possible that the exposure amount check circuit 57 also checks the exposure amount of the recording sheet 10 at the end of yellow frame main fixing, to determine whether the exposure amount during the yellow frame main fixing is sufficient enough for fixing the yellow frame completely. If so, the yellow fixing lamp 31 is turned off, and the recording sheet 10 is transported rearward at the maximum speed Vmax, to bring the recording sheet 10 back to the print start position as soon as possible. Such a case can occur when the thermosensitive color printer makes successive printing on a plurality of recording sheets and thus the tube temperature is maintained in a sufficiently high range.

Because the radiant intensity of the fixing lamp 31 or 32 begins to decrease when the tube temperature goes above the higher limit, it is desirable to provide a fan to cool the lamp 31 or 32 when the tube temperature goes above the higher limit, especially for the magenta fixing lamp 32 that is always driven up to its maximum intensity.

Although the magenta fixing lamp 32 is always driven up to the full in the above embodiments, it is possible to control the magenta fixing lamp to maintain its irradiance at a set value during the main fixing, for example, in the same way as the yellow frame main fixing. In that case, the necessity of the refixing is determined based on an exposure amount of the main fixing that is determined by the set irradiance value and the predetermined transport speed for the main fixing. If the refixing is determined to be necessary, the magenta fixing lamp is driven to the full during the refixing. The transport speed for the magenta frame refixing may be controlled in the same way as the third embodiment.

The maximum pulse duty factor of the drive pulses for the fixing lamps is not limited to 100%, but may be an appropriate largest value in an adjustable range of the duty factor.

It is also possible to determine an irradiance set value for the magenta frame refixing in accordance with the irradiance value LM2 measured at the end of the magenta frame main fixing, and control the magenta fixing lamp at the set value during the refixing. In that case, the transport speed for the magenta frame refixing may be determined by the irradiance set value and the exposure amount during the main fixing in combination.

Although the present invention has been described with respect to those thermosensitive color printers where the recording sheet is transported back and forth through the thermal heads, the present invention is applicable to a thermosensitive color printer where the recording sheet is wound around a platen drum and is transported in the same direction relative to a thermal head by rotating the platen drum. The present invention is also applicable to a printer for use with a thermosensitive color recording medium that has a fourth thermosensitive coloring layer for recording a fourth color, e.g. black, in addition to the yellow, magenta and cyan coloring layers.

Thus, the present invention is not to be limited to the above described embodiments but, on the contrary, various modifications will be possible to those skilled in the art without departing from the scope of claims appended hereto.

What is claimed is:

1. A thermosensitive color printing method for printing a full-color image on a thermosensitive color recording medium including a support, and a plurality of thermosensitive coloring layers formed on the support, wherein a thermal head effects thermal recording on one of the coloring layers during a first relative movement of the recording medium relative to the thermal head, and an optical fixing device effects optical fixing of said one coloring layer after said thermal recording during said first relative movement as well as during a second relative movement of the recording medium relative to the thermal head, said printing method comprising the steps of:

measuring, with a sensor, a first maximum irradiance of said optical fixing device while driving said optical fixing device by a drive pulse signal at a maximum duty factor, prior to said first relative movement of the recording medium;

determining a first irradiance set value in accordance with said first maximum irradiance;

causing said first relative movement of the recording medium at a first speed predetermined according to a thermal sensitivity of said one coloring layer;

adjusting duty factor of said drive pulse signal to maintain said optical fixing device at said first irradiance set value during said first relative movement of the recording medium;

detecting a second maximum irradiance of said optical fixing device prior to said second relative movement of the recording medium;

determining a second irradiance set value in accordance with said second maximum irradiance;

causing said second relative movement at a second speed that is determined in accordance with said second irradiance set value; and adjusting duty factor of said drive pulse signal to maintain said optical fixing device at said second irradiance set value during said second relative movement of the recording medium.

2. A thermosensitive color printing method as claimed in claim 1, wherein said second maximum irradiance is estimated from the duty factor of said drive pulse signal at the end of said first relative movement and an irradiance value of said optical fixing device measured with said sensor at the end of said first relative movement.

3. A thermosensitive color printing method as claimed in claim 1, wherein said second maximum irradiance is measured with said sensor while driving said optical fixing device at said maximum duty factor.

4. A thermosensitive color printing method as claimed in claim 3, further comprising the step of inserting a shutter between said optical fixing device and the recording medium while said second maximum irradiance is measured.

5. A thermosensitive color printing method as claimed in claim 1 or 4, wherein the recording medium is transported in a forward direction for said first relative movement, and in a rearward direction for said second relative movement.

6. A thermosensitive color printing method as claimed in claim 1, wherein said steps of measuring said first maximum irradiance and determining said first irradiance set value are executed while the recording medium is placed at a print start position where the thermal head starts said thermal recording.

7. A thermosensitive color printing method as claimed in claim 1, wherein said first or second irradiance set value is determined by multiplying said first or second maximum irradiance by a coefficient of less than 1 respectively.

8. A thermosensitive color printing method as claimed in claim 1, wherein said second speed is calculated based on said first irradiance set value, said first speed and said second irradiance set value, such that a total amount of exposure of the recording medium to optical fixing rays from said optical fixing device during said first and second relative movements comes to be a predetermined level.

9. A thermosensitive color printing method for printing a full-color image on a thermosensitive color recording medium including a support, and a plurality of thermosensitive coloring layers formed on the support, wherein a thermal head effects thermal recording on one of the coloring layers during a first relative movement of the recording medium relative to the thermal head, and an optical fixing device effects optical fixing of said one coloring layer after said thermal recording during said first relative movement as well as during a second relative movement of the recording medium relative to the thermal head, said printing method comprising the steps of:

causing the first relative movement of the recording medium at a first speed predetermined according to a thermal sensitivity of said one coloring layer;

driving said optical fixing device by a drive pulse signal at a constant duty factor during said first relative movement;

measuring, with a sensor, a minimum irradiance of said optical fixing device during said first relative movement of the recording medium;

estimating a minimum exposure amount of the recording medium to rays from said optical fixing device during said first relative movement, based on said minimum irradiance and said first speed;

comparing said minimum exposure amount with a predetermined lower limit of exposure amount necessary for fixing said one coloring layer completely;

determining, if said minimum exposure amount is less than said predetermined lower limit, a second speed for said second relative movement based on said minimum exposure amount and an initial irradiance value measured at the end of said first relative movement;

starting said second relative movement at said second speed while driving said optical fixing device at said constant duty factor;

measuring irradiance of said optical fixing device during said second relative movement, to compare it with said initial irradiance value; and correcting said second speed upward as said measured irradiance goes above said initial irradiance value, or downward as said measure irradiance goes below said initial irradiance value.

10. A thermosensitive color printing method as claimed in claim 9, wherein if said minimum exposure amount is not less than said lower limit, a predetermined maximum speed is used for said second relative movement.

11. A thermosensitive color printing method as claimed in claim 9, wherein said second speed is calculated based on said minimum exposure amount and said initial irradiance value such that said minimum exposure amount plus an exposure amount determined by said second speed and said initial irradiance value come to said lower limit.

12. A thermosensitive color printing method as claimed in claim 9, wherein said constant duty factor is a maximum duty factor of said drive pulse signal.

13. A thermosensitive color printer for printing a full-color image on a thermosensitive color recording medium including a support, and first, second and third thermosensitive coloring layers formed on the support in this order from an obverse of the recording medium, said printer comprising:

a thermal head for heating the recording medium to record first to third color frames of the full-color image respectively on the first to third coloring layers sequentially from the first coloring layer;

a moving device for moving the recording medium relative to the thermal head, wherein the thermal head effects thermal recording on one of the first to third coloring layers during one relative movement of the recording medium to the thermal head;

a first fixing lamp for applying ultraviolet rays to the recording medium in a first wavelength range to fix the first coloring layer optically after said thermal recording on the first coloring layer;

a second fixing lamp for applying ultraviolet rays to the recording medium in a second wavelength range to fix the second coloring layer optically after said thermal recording on the second coloring layer;

an irradiance measuring device for measuring irradiance of said second fixing lamp;

a device for checking if it is necessary to refix the second coloring layer with reference to a minimum irradiance of the second fixing lamp measured during fixation of the second coloring layer;

a speed setting device for determining a transport speed of the recording medium for said refixing of the second coloring layer in accordance with an initial irradiance value of the second fixing lamp measured immediately before starting refixing; and a speed correction device for correcting said transport speed for said refixing in accordance with irradiance of the second fixing lamp measured during said refixing to accelerate said transport speed when said measured irradiance increases from said initial irradiance value, or decelerate said transport speed when said measured irradiance decreases from said initial irradiance value.

* * * * *